United States Patent [19]

Smith

[11] Patent Number: 4,666,379

[45] Date of Patent: May 19, 1987

[54] CO-ROTOR ENGINE AND DRIVE APPARATUS

[76] Inventor: Russel I. Smith, 3055 Kincaid, Eugene, Oreg. 97045

[21] Appl. No.: 873,096

[22] Filed: Jun. 5, 1986

Related U.S. Application Data

[63] Continuation of Ser. No. 226,695, Jan. 21, 1981, abandoned.

[51] Int. Cl.[4] ..... F02B 53/00; F03C 3/00

[52] U.S. Cl. ..... 418/35; 123/245; 464/25

[58] Field of Search ..... 418/35; 123/245; 464/24, 25

[56] References Cited

U.S. PATENT DOCUMENTS 4,127,367 11/1978 Smith ..... 418/35

4,319,551 3/1982 Rubinshtein ..... 418/35

FOREIGN PATENT DOCUMENTS 2248740 5/1975 France ..... 464/24

43194 10/1917 Sweden ..... 464/24

*Primary Examiner*—Carl Stuart Miller

*Attorney, Agent, or Firm*—Kolisch, Hartwell & Dickinson

[57] ABSTRACT

A rotary drive apparatus having a drive shaft driven by a pair of start-and-stop rotary elements. Each element has a plurality of angularly spaced vanes which are interspersed with associated vanes on the drive shaft to form substantially sealed fluid chambers. Gas compression and expansion in alternate fluid chambers produced by relative rotational movement of the rotary elements with respect to the shaft acts to drive the shaft at a relatively constant velocity.

3 Claims, 2 Drawing Figures

CO-ROTOR ENGINE AND DRIVE APPARATUS

This application is a continuation of prior filed application entitled ROTARY DRIVE APPARATUS filed Jan. 21, 1981 having Ser. No. 06/226,695, now abandoned.

BACKGROUND AND SUMMARY

The present invention relates to a rotary drive apparatus, and in particular, to one having a pair of rotary elements which rotate about a common axis in start-and-stop cycles which are out of phase with each other.

In my U.S. Pat. No. 4,127,367 issued Nov. 28, 1978, there is disclosed a rotary fluid motor having a pair of start-and-stop rotary elements which are driven alternately in a forward direction under the influence of an external source of pressurized gas. The rotary elements are coupled to a rotary drive shaft in the motor by means of a spring drive connection which operates to "cushion" the torque which is applied to the drive shaft from the two start-and-stop elements, thus providing a substantially smooth drive connection between the elements and the drive shaft. The springs are subject to rapid metal fatigue and ultimately may lose some or most of their elasticity. When this occurs, the rotational movement of the drive shaft acquires more of the start-and-stop character of the driving rotary elements.

In the rotary fluid apparatus of the present invention, the rotary elements are coupled to the drive shaft by a fluid gradient which is formed in response to rotational advancement of the rotary elements with respect to the shaft. In the embodiment of the invention described herein, the drive shaft in the apparatus has, adjacent opposed shaft ends, angularly spaced vanes which are interspersed with angularly spaced vanes on associated rotary elements to form substantially sealed fluid chambers. Gas compression and expansion in alternate fluid chambers produced by relative rotational movement of the rotary elements with respect to the shaft acts to drive the shaft at a relatively constant velocity.

A general object of the invention is to provide a rotary fluid apparatus which overcomes performance and maintenance problems inherent in a rotary fluid motor having spring-like connections between its drive shaft and a pair of start-and-stop driving elements.

Another specific object of the present invention is to provide in a rotary fluid motor having a pair of start-and-stop rotary elements a compressible fluid drive connection between the rotary elements and a drive shaft in the motor.

Another object of the present invention is to provide a rotary fluid apparatus having a substantially constant velocity drive output.

These and other objects and features of the present invention will become more fully apparent when the following detailed description of a preferred embodiment of the invention is read in connection with the accompanying drawings.

DETAILED DESCRIPTION OF A PREFERRED EMBODIMENT OF THE INVENTION

Figure 2:
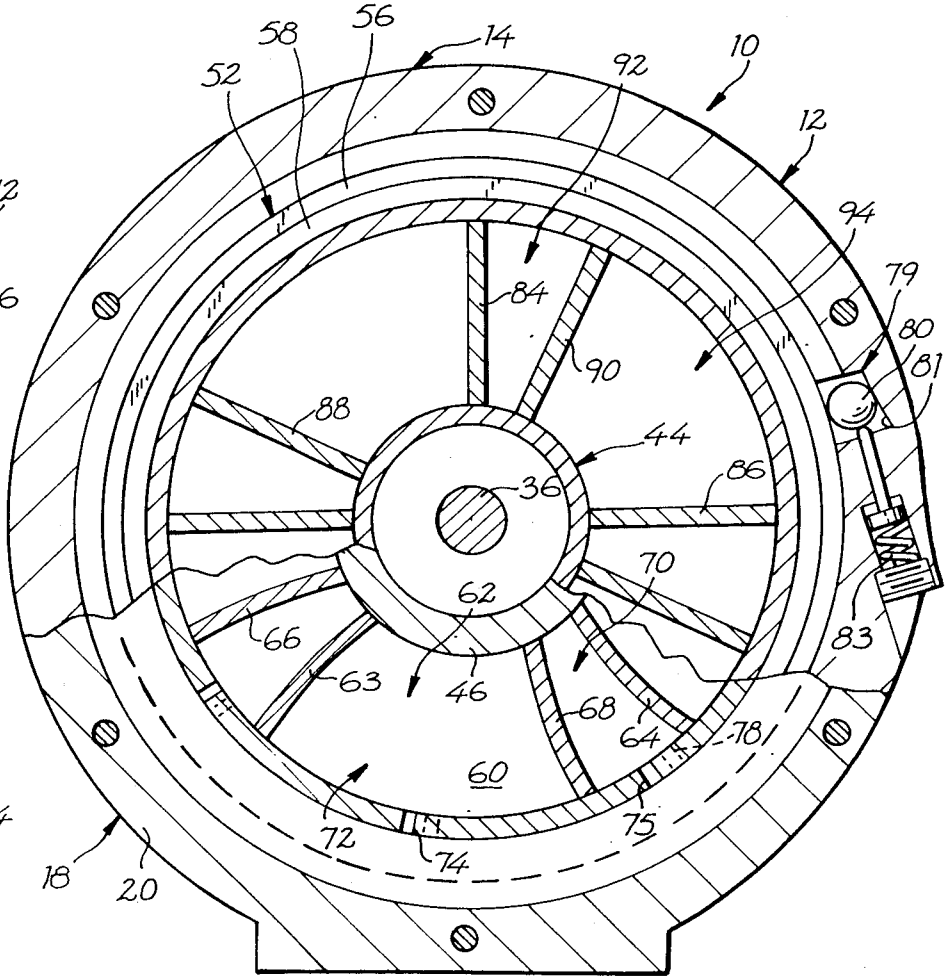
FIG. 2 is a sectional, partially cutaway view of the apparatus in FIG. 1 taken along line 2—2 therein.
Figure 1:
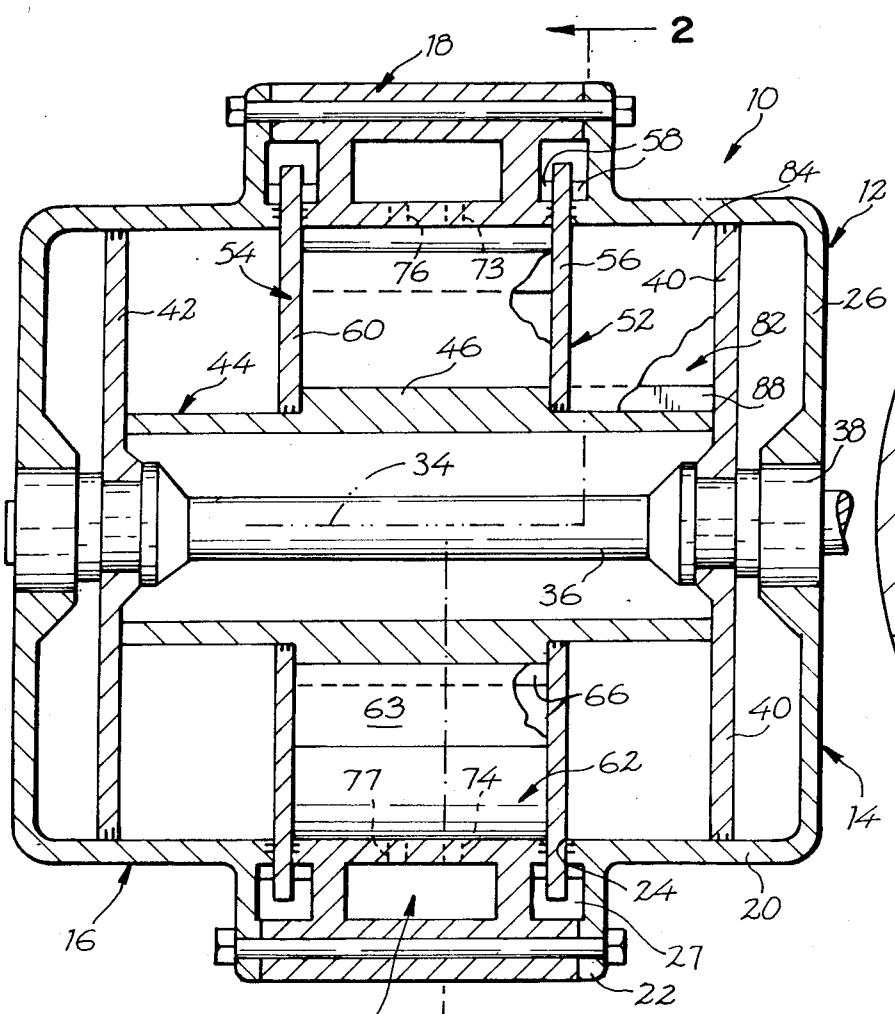
FIG. 1 is a sectional view of the apparatus of the present invention, taken substantially along a plane containing the drive shaft in the apparatus.

A fluid drive motor, or apparatus, constructed according to the present invention is shown at 10 in FIGS. 1 and 2. The motor includes a casing 12 in which the moving parts of the engine are housed. The casing is formed of a pair of mirror-image end sections 14, 16 and an annular center section 18 bolted between the end sections, as seen in FIG. 1. Section 14 includes a cylindrical wall 20 and an annular flange 22 adjacent the left end edge of wall 20 in FIG. 1. The flange and end region of wall 20 define an upright annular channel, as seen in the figure. The section is capped at its right end in FIG. 1 by an end plate 26.

Center section 18 defines, at its opposite ends, a pair of upright annular channels (FIG. 1) which form with the confronting annular channels in end sections 14, 16, a pair of annular spaces, such as space 27 between sections 18, 14. The end of the wall in each end section, such as section 14, and the confronting wall edge in section 18 define therebetween, a disc-shaped gap, such as gap 24. Section 18 has a hollow annular interior region 32. Sections 14, 16, 18 are formed conventionally by metal casting.

A drive shaft 36 is journaled to casing 12 by bearings, such as bearing 38, for rotation about axis 34. A pair of discs 40, 42 are concentrically mounted adjacent the shaft's right and left ends, respectively, in FIG. 1, and secured thereto for rotation with the shaft about axis 34. Conventional labyrinth seals placed between the peripheral edges of the discs and confronting wall portions in the casing provide substantially fluid-tight rotary seals therebetween.

A cylindrical sleeve 44 extends between the inwardly facing (confronting) sides of discs 40, 42 and may be rigidly secured at its opposed ends to the the two discs for rotation with shaft 36 as shown in FIG. 1, or may be mounted on the discs by bearings for independent rotation with respect to the shaft. A central, radially-enlarged step 46 on sleeve 44 forms a pair of annular shoulders at its left and right ends in FIG. 1 which are axially aligned with the two gaps, such as gap 24, formed in casing 12.

A pair of rotary elements 52, 54 are mounted in casing 12 for independent rotation about axis 34. Element 52, which is representative, includes a disc-like plate 56 dimensioned to extend radially from sleeve 44 through gap 24 into space 27, as shown in FIG. 1. Plate 56 is mounted on element 22 for rotation with respect thereto by a pair of bearings 58. Conventional labyrinth seals placed between plate 56 and the annular casing wall edges forming gap 24, and between the inner edge of the plate and sleeve 44 provide substantially fluid-tight rotary seals therebetween. A plate 60 in element 54 is similarly mounted for rotation in the casing. The confronting sides of plates 56, 60 and the annular wall portions of step 46 and casing 12 which the two plates bound define an annular central cavity 62 which has the rectangular cross sectional shape seen in FIG. 1.

Located within cavity 62 is a plurality of equally angularly spaced vanes (motor vanes), such as vanes 63 (FIGS. 1 and 2) and 64 (FIG. 2), which are rigidly secured to plate 56 to extend axially into cavity 62. The vanes, which have the cross sectional curvature seen in FIG. 2, are dimensioned to span the cross sectional area of cavity 62. The spacing between the free edges of the vanes and associated wall portions defining cavity 62 is such as to provide substantially fluid tight seals therebetween as the vanes are moved within the cavity.

Interspersed between the vanes in element 52 are an equal number of vanes (motor vanes), such as vane 66 (FIGS. 1 and 2) and 68 (FIG. 2), carried on plate 60 at equal angularly spaced intervals. These vanes, like the vanes in element 52, are constructed for substantially fluid-sealed movement within cavity 62. Thus, with reference to FIG. 2, the pairs of interspersed vanes in the two rotary elements define in cavity 62 a plurality of fluid chambers, such as chamber 70 defined between vanes 64, 68, and chamber 72 defined between vanes 63, 68.

A plurality of angularly spaced inlet ports, such as ports 73, 74, 75 seen in one or both of the figures, extend through the inner wall in center section 18 and are angularly spaced thereon to communicate with individual fluid chambers in cavity 62. Plural outlet ports, such as ports 76, 77, 78 seen in one or both of the figures, are similarly disposed on section 18 to communicate with the fluid chambers in the cavity. The inlet and outlet ports are connected to suitable manifold devices (not shown) which function to convey compressed gas to alternate inlet ports while exhausting gas from the adjacent alternate outlet ports. The inlet and outlet ports thus form means for admitting and exhausting gas, respectively, in the fluid chambers in cavity 62.

For each rotary element in apparatus 10, such as element 52, there is provided one or more reverse-motion brakes, such as the brake 79 shown in FIG. 2, which functions to prevent reverse-direction rotation of the associated rotary element. Brake 79, which is representative, includes a ball 80 which may move angularly within a tapered cavity 81 against the biasing of a spring 83. It can be appreciated in FIG. 2 that movement of element 52 in a counterclockwise direction in this figure moves ball 80 upwardly, in the direction of spring biasing, to a wedged position where the ball acts to brake further counterclockwise movement of the element. Movement of element 52 in a clockwise direction, acts to move the ball away from its wedged, braking position, and thus allows free clockwise movement of the rotary element. Brakes, such as brake 79, are also referred to herein as reactive means for preventing reverse rotation of the rotary elements. This reactive means, and the just-mentioned means for admitting and exhausting gas in the fluid chambers in cavity 62 are also referred to herebelow collectively as fluid drive means. The reader is referred to my U.S. Pat. No. 4,127,367 for additional details of fluid drive means such as that employed herein.

According to the important feature of the present invention, rotary elements 52, 54 are connected to shaft 36—to drive the same at a substantially constant velocity about axis 34—by fluid compression means associated with each of the rotary elements. Describing the fluid compression means associated with element 52, and with reference first to FIG. 1, it is seen that plate 56 and disc 40 on shaft 36 define therebetween an annular end cavity 82 having the rectangular cross section shown. It is noted here that cavity 82 is substantially sealed during engine operation by virtue of the above-mentioned labyrinth seals.

Carried on the right face of plate 56 in FIG. 1, at equal angularly spaced intervals thereon, is a plurality of outer vanes (power-transmitting vanes), such as vanes 84 (FIGS. 1 and 2) and 86 (FIG. 2). These vanes, which have the cross sectional shape seen in FIG. 2, are dimensioned to form a substantially fluid tight seal with wall portions of the cavity against which relative movement occurs. Interspersed with the outer vanes on element 52 are an equal number of vanes (shaft vanes), such as vanes 88, 90 (FIG. 2). These vanes are carried on the left face of disc 40 in FIG. 1 and are dimensioned to form a substantially fluid tight seal with relatively moving wall portions defining cavity 82. The interspersed vanes in cavity 82 form plural, substantially sealed fluid chambers, such as chambers 92, 94 between vanes 84, 90, and vanes 90, 86, respectively. The fluid compression means associated with element 54 is substantially identical to that just-described.

In operation, compressed gas is supplied to alternate inlet ports communicating with alternate fluid chambers in cavity 62, and simultaneously exhausted from alternate adjacent chambers by means of manifold devices mentioned above. The two elements then rotate relatively to allow volume expansion in the gas-supplied fluid chambers. That is, one of the elements rotates slightly to a braked position and the other element rotates in a clockwise direction in FIG. 2. After the moving element has advanced a defined distance in relation to the inlet and outlet ports, the supply and exhaust of gas to the chambers, through the above-mentioned manifolds, is switched so that previously evacuated chambers are supplied compressed gas and chambers previously supplied compressed gas are evacuated. The element which was previously stationary now advances rotationally, in a clockwise direction, while the other element is held in a braked condition. With continued alternate supply of compressed gas to alternate chambers in cavity 62, rotary elements 52, 54 advance rotationally about axis 34 in start-and-stop cycles which are 180° out of phase with one another.

Looking at FIG. 2, it is appreciated that as element 52 rotates in a clockwise direction, relative to shaft 36, vanes 84, 86 on the element move toward and away from vane 90, respectively. This relative movement increases the gas pressure on the left side of vane 90 in FIG. 2 and similarly decreases the gas pressure on the right side thereof, producing a gas pressure gradient which acts to rotate shaft 36 in a clockwise direction. After the rotational phase of element 52 ends, the shaft continues to rotate by inertia into the rotational phase of element 54, which then acts to drive the shaft in the same direction. Accordingly, as the two rotary elements alternately and recurrently advance rotationally, the shaft experiences alternate torque "pulses" which act to keep the shaft rotating at a relatively constant velocity, (equal to the combined average velocity of the two stop-and-start elements).

From the above, it is seen how the objects of the present invention are met. The fluid drive means described herein effectively replaces spring-like elements formerly used in the drive connection of a rotary fluid motor driven by a pair of stop-and-start elements. Unlike spring elements, which lose their resilience over time, the instant fluid drive means provides smooth torque coupling between start-and-stop elements and a drive shaft over long time periods. This is particularly advantageous in minimizing motor wear due to uneven shaft rotation. Maintenance is also reduced by eliminating the need for periodic spring replacement.

While a preferred embodiment of the invention has been disclosed herein, it is obvious that various changes and modifications can be made without departing from the spirit of the invention.

It is claimed and desired to secure as Letters Patent:

1. A rotary drive apparatus comprising:

a casing having a hollow interior, an elongate power-output shaft journaled in said casing and extending through the interior thereof between its ends, a first rotary element coaxial with said shaft within the casing interior and adjacent one end of the casing rotatable relative to said shaft and said casing and including a disc surrounding and extending radially of said shaft with inner and outer perimeters of the disc fluidly sealed relative to the shaft and casing, respectively, a first series of power-transmitting vanes distributed circumferentially about and secured to one side of said disc and extending axially toward one end of the casing and a first series of motor vanes distributed circumferentially about and secured to the other side of said disc and extending axially toward the casing's opposite end, a second rotary element coaxial with said shaft within the casing interior and adjacent the opposite end of the casing rotatable relative to said shaft and casing and including another disc spaced axially toward the opposite end of the casing from the first-mentioned disc and extending radially of said shaft with inner and outer perimeters of the disc fluidly sealed relative to the shaft and casing, respectively, another series of power-transmitting vanes distributed circumferentially about and secured to one side of said other disc and extending axially toward the casing's opposite end and another series of motor vanes distributed circumferentially about and secured to the other side of said disc and extending axially toward the casing's said one end, said first series of motor vanes and said other series of motor vanes being interspersed with each other and forming a plurality of angularly spaced fluid motor chambers located between said first-mentioned and other disc within said casing, means on the casing to admit gas under pressure into alternate ones of said fluid chambers and to exhaust gas from alternate ones of said fluid motor chambers, a first series of shaft vanes secured to and circumferentially distributed about the shaft within the casing interior adjacent one end of the casing interspersed with the first series of power-transmitting vanes of the first rotary element and a second series of shaft vanes secured to and distributed circumferentially about the shaft within the casing interior adjacent the opposite end of the casing interspersed with said other series of power-transmitting vanes of the second rotary element, each series of shaft vanes together with the power-transmitting vanes of a rotary element interspersed therewith forming plural, substantially air-tight fluid end chambers and rotational advancement of the rotary element in one direction with respect to said shaft producing between adjacent fluid end chambers fluid pressure gradients which act to rotate the shaft in the direction of such advancement, and reactive means on the casing associated with each of the rotary elements operable to prevent rotation of the rotary element in a direction opposite to said one direction, whereby gas alternately admitted under pressure into alternate ones of said fluid motor chambers and exhausted from alternate adjacent fluid motor chambers drives said rotary elements alternately in said one direction.

2. The rotary drive apparatus of claim 1, wherein the first series of shaft vanes adjacent one end of the casing are secured to the shaft through a mounting disc coaxial with the shaft and secured to the shaft which has the shaft vanes distributed thereabout and secured thereto, and the second series of shaft vanes adjacent the opposite end of the casing are secured to the shaft through another mounting disc coaxial with the shaft and secured to the shaft having said second series of shaft vanes distributed thereabout and secured thereto.

3. The rotary drive apparatus of claim 2, which further includes a cylindrical sleeve extending between the inwardly facing sides of said first and said other mounting discs coaxial with the shaft, outer surface regions of said sleeve delineating the the radially inner extents of said fluid motor chambers and said fluid end chambers.

* * * * *